United States Patent [19]

Wallman

[11] Patent Number: 4,495,059

[45] Date of Patent: Jan. 22, 1985

[54] STEAM RECYCLE USED AS STRIPPING GAS IN OIL SHALE RETORTING

[75] Inventor: P. Henrik Wallman, Berkeley, Calif.

[73] Assignee: Chevron Research Company, San Francisco, Calif.

[21] Appl. No.: 522,917

[22] Filed: Aug. 12, 1983

[51] Int. Cl.[3] ..... C10G 1/00; C10B 53/06

[52] U.S. Cl. ..... 208/11 R

[58] Field of Search ..... 208/11 R

[56] References Cited

U.S. PATENT DOCUMENTS

| | | | |
|---|---|---|---|
| 2,582,712 | 1/1952 | Howard | 208/11 R |
| 3,655,518 | 4/1972 | Schmalfeld et al. | 208/11 R |
| 4,133,729 | 1/1979 | Mitchell et al. | 208/11 R |
| 4,199,432 | 4/1980 | Tamm et al. | 208/8 |
| 4,227,990 | 10/1980 | Dearth et al. | 208/11 R |
| 4,293,401 | 10/1981 | Sieg et al. | 208/11 R |
| 4,332,669 | 6/1982 | Spars et al. | 208/11 R |
| 4,336,046 | 12/1982 | Bertelsen et al. | 208/11 R |
| 4,392,942 | 7/1983 | Wallman et al. | 208/11 R |

OTHER PUBLICATIONS

Chemical Engineers' Handbook by Robert H. Perry and Cecil H. Chilton (1973) pp. 6–15, 6–29 to 6–32.

*Primary Examiner*—Delbert E. Gantz
*Assistant Examiner*—Glenn A. Caldarola
*Attorney, Agent, or Firm*—S. R. LaPaglia; W. K. Turner; D. P. Freyberg

[57] ABSTRACT

The steam content and pressure of a recycled steam/hydrocarbon gas mixture in an oil shale retorting process is raised by high quality makeup steam producing a retort stripping gas of high efficiency (high oil yield) with minimal water consumption.

8 Claims, 2 Drawing Figures

STEAM RECYCLE USED AS STRIPPING GAS IN OIL SHALE RETORTING

BACKGROUND OF THE INVENTION

Oil shale is a naturally occurring material which has a hydrocarbonaceous component referred to as kerogen that when heated decomposes to yield shale oil which may serve as a petroleum substitute. In some processes for recovering shale oil from oil shale, the shale is crushed and ground into a particulate solid prior to being introduced into a retort. In the retort the particulate shale is mixed with a hot particulate solid that serves as a heat transfer solid to raise the kerogen to a temperature capable of releasing shale oil vapors, usually a temperature of at least 800° F. In some retorting processes of this type, a non-oxidizing gas is passed through the solids mixture. The velocity of the gas depends upon its function in the retorting scheme. For example, in some schemes the gas is used to fluidize or partially fluidize the shale/heat transfer solids mixture. See, for example, U.S. Pat. No. 4,199,432. In other schemes the gas merely serves a stripping function, i.e., to aid in carrying away shale oil vapors from the retort.

Steam has been suggested for use as a stripping gas or fluidizing gas in such processes for retorting oil shale. However, the use of steam presents some serious practical problems. Areas where oil shale is usually found and consequently processed are typically arid making recycle of water in order to minimize usage essential. However, oil shale contains a number of contaminants which accumulate in a water recycle system rapidly fouling and clogging the boiler and superheater. This results in the need to treat large volumes of foul water in a treatment section before recycling to the steam boiler. In addition, the use of steam in the retorting zone results in high heat losses in the condensation section. Hence, the practical utility of steam in commerical processing has been seriously questioned.

Applicant has discovered that despite its practical problems, the use of steam as a fluidizing or stripping gas gives significantly higher product oil yields than other non-oxidizing gases such as nitrogen or recycle retort gas. Therefore, the present invention is directed to a practical method for recycling steam in an oil shale retorting process.

BRIEF DESCRIPTION OF THE INVENTION

The present invention is directed to a process for retorting oil shale which comprises: (a) mixing in a retorting zone a particulate oil shale with a hot particulate heat transfer solid in a ratio sufficient to raise the temperature of the oil shale to a retorting temperature; (b) passing a stripping gas containing at least 50 percent by weight of steam through the mixture of oil shale and heat transfer solid, whereby a mixture of stripping gas and evolved shale oil vapors is produced; (c) separating a recycle gas from the mixture of shale oil vapors and stripping gas, said recycle gas comprising steam and non-condensable hydrocarbons and having a temperature between about 150° F. and 350° F.; (d) adding sufficient high quality, high pressure steam to the recycle gas using steam injecting means to increase the pressure of the resulting mixture of gases to be in excess of that of the recycle gas and to increase the weight percent of steam in the mixture to be at least 50 percent; and (e) using the mixture of recycle gas and steam of step (d) as the stripping gas of step (b).

As used herein, the phrase "steam injecting means" refers to one or more jet injectors suitable for injecting high quality, high pressure steam into the lower pressure recycle gas to provide sufficient compression for the resulting mixture of gases to serve as a stripping gas in the retorting zone.

In the disclosed process only a portion of the total steam requirements for the stripping gas is supplied as high quality, high pressure steam. This steam, referred to as makeup steam, is added to the recycle gas to raise the steam content to at least 50 weight percent and more preferably to at least 70 weight percent. The remainder of the gas is composed of non-condensable hydrocarbons, carbon dioxide, hydrogen and some naphtha. The use of a jet injector to mix the makeup steam and recycle gas makes possible a sufficient increase in compression to drive the recycle loop.

The recycle gas recovered from the retort need not be run through a foul water stripper or otherwise treated before being returned to the retort. Since the recycle gas does not pass through a boiler or superheater, fouling is not a problem. At the same time, the steam present in the stripping gas has been observed to significantly increase the yield of shale oil from the retort as compared to other non-oxidizing gases containing either no or less steam.

DETAILED DESCRIPTION OF THE INVENTION

Figure 1:
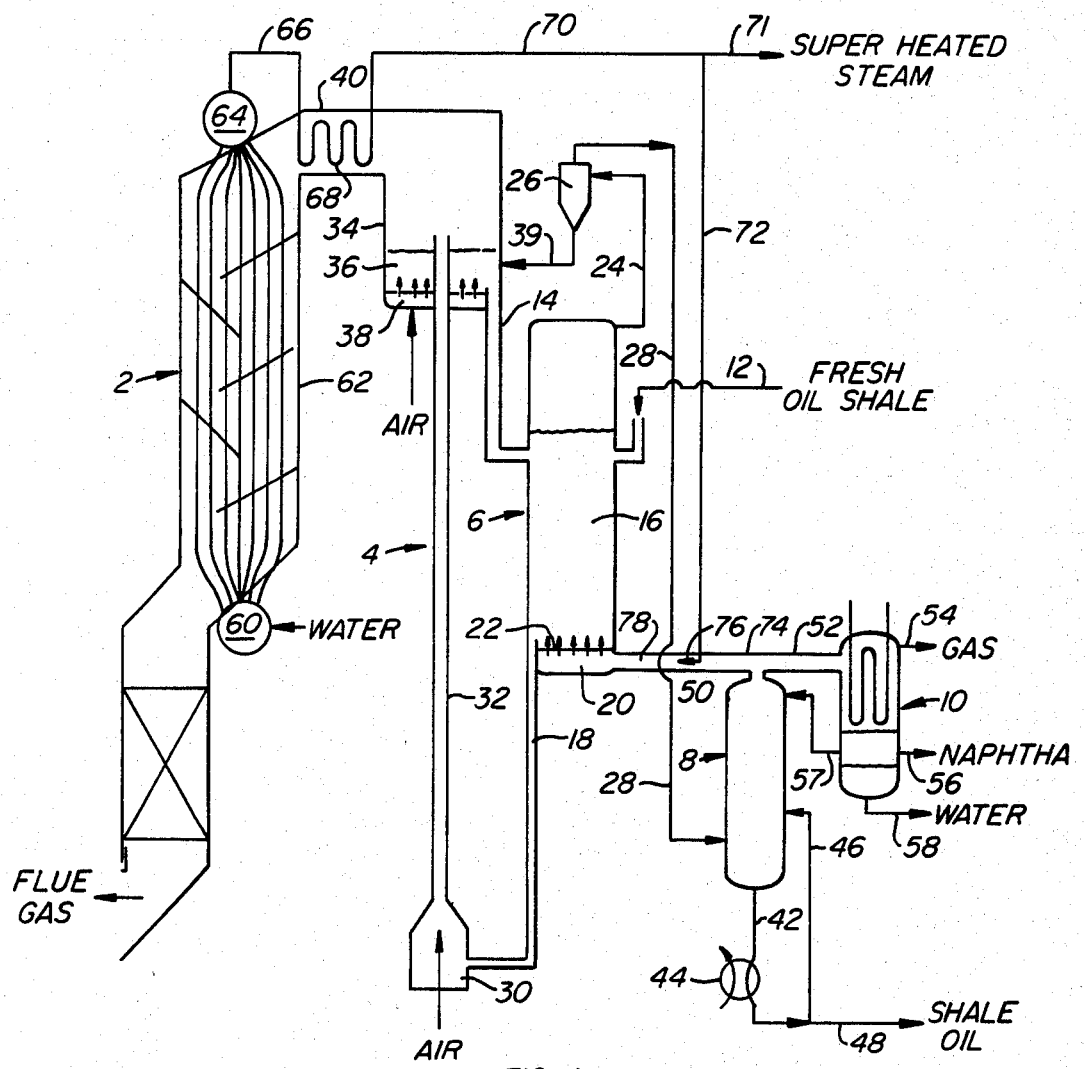
FIG. 1 is a schematic representation of a process for retorting oil shale utilizing a steam recycle loop according to the invention.

The invention may be more clearly understood by reference to FIG. 1 which represents a process for retorting oil shale using a steam recycle loop in the manner of the invention. The major components shown in the figure are a boiler 2, a combustor 4, a retort 6, a separation tower 8 and a condenser 10.

In operation, fresh oil shale crushed to a maximum particle size of about ¼ inch enters the retort 6 by shale feed conduit 12. In the retort, the oil shale is mixed with sufficient hot heat transfer material entering the retort from the combustor 4 via conduit 14 to raise the oil shale to a temperature suitable for decomposing the kerogen. Generally, this temperature is in the range of from about 850° F. to about 1000° F.

The mixture of solids forms a vertical bed 16 in the retort which moves downward as spent solids are withdrawn from the bottom by solids outlet 18. A stripping gas containing a minimum of 50 percent steam is passed through the bed of solids 16 from plenum chamber 20 located at the bottom of the retort. A distribution grid 22 distributes the stripping gas evenly across the bottom of the bed of solids. The stripping gas and evolved hydrocarbon vapors pass out the top of the retort 6 by way of outlet pipe 24. Fine particles of entrained solids are removed from the vapors by cyclone 26. From the cyclone, the vapors are sent via conduit 28 to the separation tower 8.

Returning to the retort 6, the spent mixture of retorted solids and heat transfer material is carried from the retort by solids outlet 18 to the engaging section 30 at the bottom of the liftpipe section 32 of the combustor 4.

In the engager 30, the solids are entrained in a stream of hot air and carried up the length of the liftpipe section 32. In the liftpipe, the carbonaceous residue that remains in the retorted shale after decomposition of the kerogen is partially burned. The partially burned solids leave the top of the liftpipe and enter the secondary combustion and disengaging chamber 34 of the combustor. The partially burned solids form a bed of material 36 in the bottom of the chamber which is fluidized by additional air supplied by plenum chamber 38. Any remaining carbonaceous residue is burned in this chamber. In addition, fine solids removed from the retort vapors by cyclone 26 are fed directly into this area of the combustor by fine solids feed conduit 39. The hot coarse solids, now at a temperature of about 1300° F., are recycled to the retort via conduit 14 as hot heat transfer solids. Flue gas with entrained fine solids leaves the top of the secondary combustion and disengaging chamber 34 by flue gas outlet 40, which also serves as a superheater for steam from the boiler 2.

In the separation tower 8 light overhead gases are separated from the higher boiling fractions. A bottoms fraction is collected at the bottom of the separation tower and withdrawn via conduit 42. This bottoms fraction is passed through a cooler 44 and part of the cooled oil is recycled to the tower via recycle loop 46. The rest of the cooled bottoms fraction is recovered as shale oil by conduit 48.

Overhead gases, at a temperature of about 220° F. and at a pressure of about 3 psig, leave the top of the separation tower by overhead outlet 50 and are divided into two streams. One stream is carried by conduit 52 to the condenser 10. In the condenser, non-condensable gases 54 are separated from naphtha 56 and water 58 (condensed from steam). Part of the naphtha is recycled to the tower via conduit 57. The second stream of overhead gases is used as recycle gas for return to the retort as part of the stripping gas.

In order to provide sufficient compression for the stripping gas, makeup steam must be generated for use in the process. In the present scheme, water added to water drum 60 of the boiler 2 passes through the boiler tubes 62 heated by flue gases and hot fines from the combustor to yield steam. From steam drum 64, steam is carried via conduit 66 to the steam superheater 68 located in the flue gas outlet 40 of the combustor. In the superheater, the steam is heated to about 800° F. at a pressure of about 800 psig. This high pressure, superheated steam is collected in conduit 70. The superheated steam may be drawn off by line 71 and used as turbine steam to drive the air compressor for the combustor and/or to drive power generators. Part of the superheated steam is carried by conduit 72 for injection into the recycle gas from the separation tower 8.

As noted above, the recycle stream from the tower overhead is carried back to the plenum chamber 20 of the retort by recycle conduit 74. The superheated steam from conduit 72 is injected into the recycle stream by a jet injector 76. The mixture of recycle gas and superheated steam at a temperature of about 400° F. and at a pressure of about 20 psig is returned to the retort by stripping gas conduit 78.

In the process outlined above, only part of the steam requirements for the stripping gas are supplied by fresh superheated steam from the boiler. The superheated steam provides compression for the stripping gas, but the majority of the steam is recycled from the tower overhead. Despite the low requirement for fresh superheated steam, the process described above will yield significantly better yields of shale oil as compared to a similar process using a conventional stripping gas other than steam.

Typical material balances for a retorting process such as shown in FIG. 1 are given in the following table:

Material Balances for Oil Shale Retorting Process as Shown in FIG. 1 for 1 lb. of Crushed Oil Shale Yielding 28 Gallons/Ton Shale Oil and 0.02 lb. Water

| | |
|---|---|
| Shale Oil (conduit 48) | 0.1 lb. |
| Gas (line 54) | 0.02 lb. |
| Naphtha (line 56) | 0.01 lb. |
| Water (line 58) | 0.045 lb. |
| Superheated Steam (conduit 70) | 0.15 lb. |
| Turbine/Process Steam (line 71) | 0.125 lb. |
| Makeup Steam (line 72) | 0.025 lb. |
| Recycle Gas (recycle conduit 74) | 0.05 lb. |
| Stripping Gas (conduit 78) | 0.075 lb.* |

*The stripping gas in this embodiment will contain about 73 percent steam, 18 percent non-condensable gases and 9 percent naphtha (all by weight).

Figure 2:
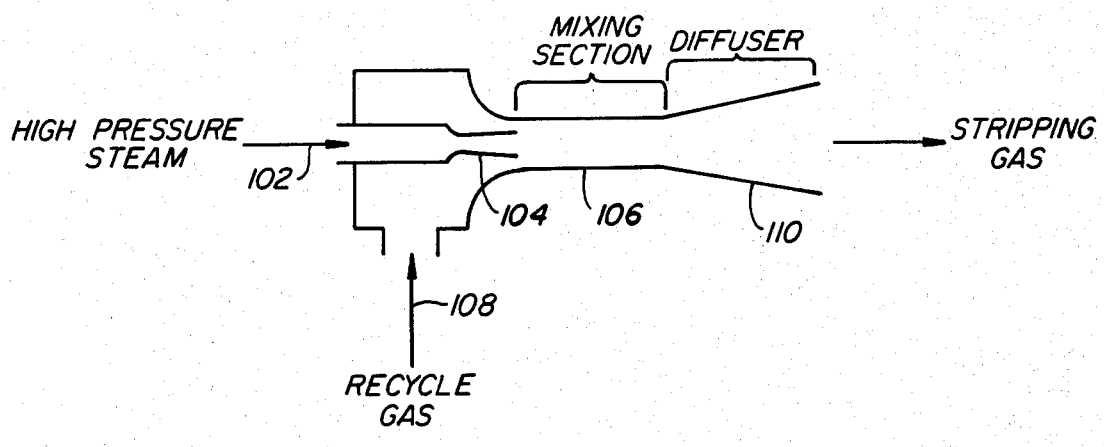
FIG. 2 is a side elevation view in cross-section of a steam jet injector that constitutes the essential means for mixing the high pressure steam with the recycle gas according to the invention.

A typical jet injector, such as may be used to inject the high pressure steam into the recycle gas, is shown in FIG. 2. When used as part of the process disclosed herein, the high pressure steam serves as the motive gas and is injected at 102 through the converging-diverging nozzle 104 where it expands and emerges into the mixing section 106 with supersonic velocity. In the mixing section, the motive gas entrains the recycle gas which is sucked into the injector via 108. The two gases mix in the mixing section to form the stripping gas which will be sent to the retort. Deceleration of the motive gas in the mixing section and deceleration of the mixture, i.e., stripping gas, in the diffuser section 110 account for the entrainment and overall pressure increase observed between the recycle gas and the stripping gas. When used in the present process, the jet injector makes possible a sufficient increase in the pressure of the recycle loop with only a portion of the total steam requirement supplied from the boiler and superheater.

In carrying out the process of the invention, a variety of designs may be employed for the retort. Preferably, the mixture of oil shale and heat transfer solids will be contained in a vertical bed such as described in FIG. 1. However, a horizontal moving bed of solids may also be used in conjunction with the invention. The retorting zone may contain internal baffles or other flow distributors to control the movement of solids and gases through the retorting zone. In one preferred embodiment, the retorting zone contains a staged turbulent bed such as described in U.S. Pat. No. 4,199,432. The staged turbulent bed contains a vertical bed of solids which is partially fluidized to assure good mixing between the solids. Internal flow distributions prevent the formation of large bubbles in the bed and slow the passage of the large non-fluidized particles through the retort. In such a retort design, stripping gas velocity will usually fall within the range of from about 1 foot/second to about 4 feet/second depending on the particle size of the solids and degree of fluidization desired.

The temperature of stripping gas will usually fall within the range of from about 300° F. to about 900° F. Generally, the temperature will be in the lower end of the range since it is desirable to use a minimum of makeup steam in preparing the stripping gas. Therefore, temperatures will usually fall in the range of from about 350° F. to about 500° F. In the bottom of the retort the stripping gas rapidly heats up to retort bed temperature because of the high ratio between solids rate and stripping gas rate (about 50 in embodiment shown in figure). The pressure of the stripping gas will vary depending on the type of retorting system used. In one embodiment shown in FIG. 1, the pressure is about 20 psig. This pressure is suitable for a partially fluidized bed such as the staged turbulent bed. Higher pressure would be employed for deep fluidized beds of similar design. Likewise, lower pressures would be used for a vertical moving packed bed where there is little or no fluidization of the solids. The pressure would also be dependent on bed design, such as, for example, bed depth, maximum particle size, presence of baffles or other internals. The utility of the present invention is not limited to any particular design of retort. Generally, the pressure of the recycle gas will fall within the range of from about 5 psig to about 50 psig.

The recycle gas recovered from the overhead of the separation tower or similar device will usually have a temperature in the range of from about 150° F. to about 350° F. and most preferably from about 200° F. to about 250° F. The low temperature limit of approximately 200° F. is set by the dew point of the steam in the vapor leaving the top of the tower. With unusually low steam partial pressures in this stream, the dew point may be as low as 150° F. It is usually desirable to operate the recycle loop at a low enough temperature that only a small fraction of naphtha or other low boiling hydrocarbons are present in the recycle gas but at a high enough temperature to avoid water condensation in the tower. Therefore, a cut temperature of about 220° F. is preferred. Temperatures substantially below 200° F. can be achieved by recycling process gas after the overhead condenser but this results in reduced amounts of recycled steam. This translates into increased makeup steam requirements. Since it is desirable to use a minimum amount of fresh makeup steam and at the same time to limit the amount of naphtha in the recycle gas, temperatures outside the preferred range result in a decrease in efficiency. The pressure of the recycle gas will vary depending upon the design of the separator and the temperature of the cut, but generally will fall in the range of from about 0 psig to about 10 psig.

What is claimed is:

1. A process for retorting oil shale which comprises:

(a) mixing in a retorting zone a particulate oil shale with a hot particulate heat-transfer solid in a ratio sufficient to raise the temperature of the oil shale to a retorting temperature;

(b) passing a non-oxidizing stripping gas containing noncondensable hydrocarbons and at least 50 percent by weight of steam through the mixture of oil shale and heat-transfer solid, whereby a mixture of stripping gas and evolved shale oil vapors is produced;

(c) separating a recycle gas from the mixture of shale oil vapor and stripping gas, said recycle gas comprising steam and non-condensable hydrocarbons;

(d) adding sufficient high quality, high pressure steam to the recycle gas using a steam injecting means to increase (i) the pressure of the resulting mixture of gases above that of the recycle gas to enable the use of the mixture as the stripping gas of step (b), and (ii) the weight percent of steam in the mixture to at least 50 percent; and (e) using the mixture of recycle gas and steam of step (d) as the stripping gas of step (b).

2. The process of claim 1 wherein sufficient high quality, high pressure steam is mixed with the recycle gas to yield 70 percent by weight of steam.

3. The process of claim 1 wherein the mixture of oil shale and hot particulate solids in the retating zone is at least partially fluidized by the stripping gas.

4. The process of claim 1 wherein the mixture of oil shale and hot particulate solids is contained in a vertical retorting zone.

5. The process of claim 4 wherein the retorting zone contains a staged turbulent bed.

6. The process of claim 1 wherein the temperature of the stripping gas is in the range of from about 300° F. to about 900° F. and at a pressure of from about 5 psig to about 50 psig.

7. The process of claim 1 wherein the temperature of the recycle gas in the range of from about 150° F. to about 350° F. at a pressure of from about 0 psig to about 10 psig.

8. The process of claim 7 wherein the temperature of the recycle gas is in the range of from about 200° F. to about 250° F.

* * * * *

UNITED STATES PATENT AND TRADEMARK OFFICE

CERTIFICATE OF CORRECTION

PATENT NO. : *4,495,059*

DATED : *January 22, 1985*

INVENTOR(S) : *P. Henrik Wallman*

It is certified that error appears in the above-identified patent and that said Letters Patent are hereby corrected as shown below:

*Col. 4, line 62, "distributions" should read --distributors--.*

*Col. 6, line 31, "retating" should read --retorting--.*

*Col. 6, line 43, "gas in the range" should read --gas is in the range--.*

Signed and Sealed this

*Seventh* Day of *May 1985*

[SEAL]

*Attest:*

DONALD J. QUIGG

*Attesting Officer* *Acting Commissioner of Patents and Trademarks*